United States Patent [19]

Doyle et al.

[11] Patent Number: 4,506,534

[45] Date of Patent: Mar. 26, 1985

[54] METHOD AND APPARATUS FOR REMOVING DRAWN CONTAINER FROM DRAW HORN

[75] Inventors: Stephen D. Doyle, North Canton; Joseph D. Bulso, Jr., Canton, both of Ohio

[73] Assignee: Redicon Corporation, Canton, Ohio

[21] Appl. No.: 455,318

[22] Filed: Jan. 3, 1983

[51] Int. Cl.[3] ..... B21D 22/00

[52] U.S. Cl. ..... 72/345; 72/349

[58] Field of Search ..... 72/344, 345, 347, 348, 72/349, 427

[56] References Cited

U.S. PATENT DOCUMENTS

| | | | |
|---|---|---|---|
| 3,402,591 | 9/1968 | Maeder | 72/345 |
| 3,524,338 | 8/1970 | Bozel | 72/345 |
| 3,771,344 | 11/1973 | Wright | 72/345 |
| 3,902,347 | 9/1975 | Ridgway et al. | 72/336 |
| 3,910,095 | 10/1975 | Hortig | 72/345 |
| 3,911,719 | 10/1983 | Degenhardt | 72/345 |
| 4,007,620 | 2/1977 | Urban | 72/345 |
| 4,280,353 | 7/1981 | Murphy | 72/345 |
| 4,283,932 | 8/1981 | Putelte | 72/345 |
| 4,324,124 | 4/1982 | Maeder | 72/345 |
| 4,327,571 | 5/1982 | Cavanaugh | 72/344 |
| 4,339,939 | 7/1982 | Book | 72/349 |
| 4,343,173 | 8/1982 | Bulso, Jr. et al. | 72/345 |
| 4,373,368 | 2/1983 | Heyting | 72/349 |
| 4,416,140 | 11/1983 | Bulso | 72/345 |

FOREIGN PATENT DOCUMENTS

| | | |
|---|---|---|
| 1070541 | 6/1967 | United Kingdom . |
| 1166185 | 10/1967 | United Kingdom . |
| 1259773 | 1/1972 | United Kingdom . |
| 1366110 | 9/1974 | United Kingdom . |
| 1440618 | 6/1976 | United Kingdom . |
| 1531075 | 11/1978 | United Kingdom . |

*Primary Examiner*—Leon Gilden

*Attorney, Agent, or Firm*—Reese Taylor

[57] ABSTRACT

Apparatus for removing a drawn container from a draw horn which is carried by the inner slide of a double acting press includes a stripper assembly also carried by the inner slide and capable of controlled axial movement relatively of the draw horn. The draw horn and draw riser have coaxial, centrally disposed bores within which is received an elongate shaft of the stripper assembly. The distal end of the shaft carries a stripper pad while the proximal end is adjustably connected to a pivoting linkage mounted on the inner slide and normally pivoted under pressure by a pneumatically actuated piston so as to maintain the stripper assembly in retracted condition, the pad then forming the bottom of the horn. The method includes timing the press so that, upon movement of the inner and outer slides away from the bottom platen of the press, the inner slide trails the outer slide by a predetermined amount so that the outer slide comes into contact with one end of the pivoting linkage of the stripper assembly thereby overcoming the piston and enabling the stripper pad to be disposed in an axially extended position with respect to the draw horn. As the inner and outer slides continue to move away from the lower platen, the stripper pad, which is in contact with the bottom of the drawn container, effectively holds the container while the horn is pulled out of it. Final removal may be assisted by air pressure.

10 Claims, 9 Drawing Figures

METHOD AND APPARATUS FOR REMOVING DRAWN CONTAINER FROM DRAW HORN

FIELD OF THE INVENTION

This invention relates, in general, to the forming of containers by drawing and redrawing and relates, in particular, to a method of removing or stripping the drawn container from the draw horn following the drawing operation.

DESCRIPTION OF THE PRIOR ART

Drawing and redrawing metal containers for use in the food and beverage industry, as well as other industries, is well known. This is accomplished, in some instances, in a double acting press of the type having inner and outer slides which are independently movable toward and away from the bottom platen of the press. Typically, these presses carry a die set in the bottom platen and a cooperating draw horn on the inner slide so that, as the horn travels down to and into the die, the container is drawn and thus formed. A double acting press of the type generally referred to herein can be seen in Ridgway U.S. Pat. No. 3,902,347.

One of the difficulties encountered in operations of this type is to satisfactorily remove the formed container from the draw horn once the drawing operation is completed. This is particularly critical where draw and redraw operations are to be performed successively because it is essential to remove the drawn container without damaging or deforming it in any way since such damage will affect the efficiency of subsequent operations.

In the prior art known to Applicant, this has been accomplished in a number of ways.

Specifically, the drawn horn and its associated riser are often provided with a through bore connected to a source of air under pressure so that, essentially, the drawn container is simply blown off the end of the horn, once the horn has been retracted out of the die.

Examples of this approach to container removal can be seen in Maeder U.S. Pat. No. 3,402,591; Wright U.S. Pat. No. 3,771,344; and Murphy U.S. Pat. No. 4,280,353.

A modification of this general approach can be seen in Bulso et al. U.S. Pat. No. 4,343,173, wherein compressed air is forced through bores in the interior of the riser and draw horn and directed in a specific direction so as to not only blow the can off the end of the horn, but direct it in the desired direction for removal from the press.

The use of fluid pressure to remove, or strip, drawn containers from draw horns, as explained above and as described in the references just referred to, is in many instances satisfactory. However, difficulties are encountered where a relatively deep, narrow diameter container is formed of thin material. The stresses are such that the tendency in this situation is for the container to freeze onto the horn. With such a relatively narrow diameter container, there really is not sufficient bottom area in the formed can for the normal amount of fluid pressure to force the container off the horn. On the other hand, if the air pressure is increased sufficiently to accomplish the blow off, either bubbles are formed or the bottom of the can is collapsed. Naturally, neither of those results is desirable.

The prior art also includes mechanical means for stripping containers from the end of a draw horn. These generally take the form of spring loaded lips disposed about the periphery of the die which are automatically pushed back or retracted as the metal is forced down into the female die during the drawing operation, and then extend or spring back after the horn has passed so that they overlie the top of the die. On the upstroke of the slides, these lips will then simply engage the top edge of the can and strip it from the horn. Examples of this art can be found in Maeder U.S. Pat. No. 4,234,124 and Cavanaugh U.S. Pat. No. 4,327,571. Again, while in some instances such a mechanical stripping operation may be practicable, there is a definite tendency to damage the top edge of the can. This is unsatisfactory, of course, because for example, any wrinkles or other defects on the top edge of the can will seriously impede the effective performance of the next operation.

Applicant is also aware of some mechanical can knock outs wherein a mechanical ram is simply forced down into the can to knock it out or off the horn. The difficulty with this approach usually is that the speed and forces employed tend to deform the can bottom. Effectively, this is a true "knock out" operation wherein the slide is driven into the can and then slams into the bottom to knock it loose from the horn.

Keeping in mind that in the environment contemplated in the present invention, subsequent operations are to be performed on the can or container, it is extremely important that it be removed from the draw horn without any damage either to the metal or to the internal chemical coating which is conventionally employed in the industry.

SUMMARY OF THE INVENTION

It has been discovered that the aforementioned difficulties can be overcome by providing a draw horn with a centrally located and axially movable stripper assembly. It has been found that if the stripper assembly is mounted in the center of the draw horn and the associated riser and connected to the inner press slide by means of a pivoting linkage, that the container can be stripped from the draw horn without damage.

It has also been found that the pivoting linkage can be associated with a piston, under pneumatic or hydraulic pressure, which is sufficient to cock the linkage to hold the stripper assembly in retracted position during the draw operation so that the stripper pad actually forms the bottom surface of the draw horn during the drawing operation.

It has also been found that the press operation can be timed and designed so that upon retraction away from the bottom platen of the press, the inner slide, which carries the draw horn and the stripper assembly will trail the outer slide. In that fashion, as the outer slide retracts or moves up, it can be designed so as to engage the linkage thereby overcoming the pressure of the piston and permitting the stripper assembly to be axially extending relatively of the draw horn and riser, whereby continued retracting movement of the inner and outer slide will enable the draw horn to be pulled out of the can, thus making it possible to strip it without damage.

It has also been discovered that, in some instances, air pressure may be combined with the stripper assembly to assist removal of the drawn container.

Accordingly then, production of an improved container stripper method and apparatus of the character above described becomes the principal object of this invention with other objects thereof becoming more apparent upon a reading of the following brief specification considered and interpreted in view of the accompanying drawings.

OF THE DRAWINGS

BRIEF DESCRIPTION OF THE PREFERRED EMBODIMENT

As noted above, the present invention has particular utility in a double acting press of the type having inner and outer slides whose timing and movement are controlled by a cam arrangement, which is adjustable. A typical press of this type can be seen in Ridgway U.S. Pat. No. 3,902,347, the teachings of which are incorporated herein by reference wherever appropriate. The press itself has not been described in any great detail since a double acting press of this general type is well known to those skilled in this art.

Figure 1:
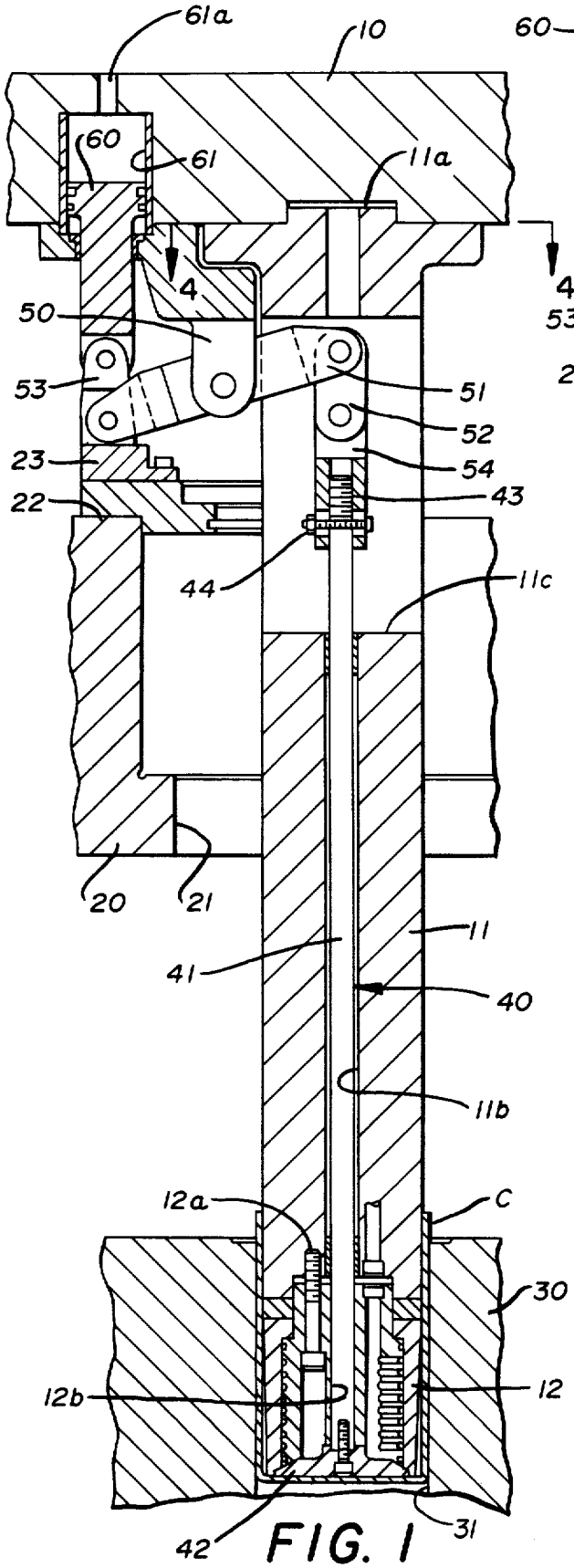
FIG. 1 is an elevational view, partially in section, showing the assembly at the bottom of the stroke with the container drawn.

Turning then to the drawings and referring first to FIG. 1, it will be noted that the press includes an inner slide or ram 10, an outer slide or ram 20 and a platen or base 30. The platen or base 30 will be understood to carry a female die suitable for cooperation with the draw horn for drawing the container. This die structure is not shown in great detail, since it again is fairly well known in this art.

The inner slide 10, which moves independently of the outer slide 20, has secured to it a riser 11 which is elongate in nature with its proximal end **11*a* secured to the slide 10 by known means. The distal end of the riser 11 carries a draw horn 12, which is secured thereto by suitable screws such as 12*a***.

Riser 11 and horn 12 also have suitable, axially extending air (**11*d*) and water (11*e***) conveying bores. The water, which is supplied by an external source, is used for cooling purposes while the air, which is also supplied by an external source, is employed, in certain applications, to assist removal of the container as will be described.

Both the riser 11 and the draw horn 12 also have through central bores coaxially arranged and indicated by the numerals **11*b* and 12*b***.

Received within these bores **11*b* and 12*b* is the stripper assembly generally indicated by the numeral 40. This assembly includes an elongate shaft 41 having a stripper pad 42 secured to its distal end. In this regard it will be noted that the draw horn 12 has a shaped recess 12*c* in its outboard end. The stripper pad 42 is contoured and dimensioned so as to normally be received within that contoured area, as illustrated in FIG. 1, so that, effectively, during the draw operation the stripper pad 42 forms the bottom wall or end of the draw horn 12**.

The opposed end of the shaft 41 of the stripper assembly 40 projects upwardly into and through the central bore **11*b* of the riser 11. In that regard, adjacent to the proximal end of the riser 11, at least one radially opening aperture 11*c*** is provided for purposes which will now be described.

The upper end of the shaft 41 is secured to a pivoting linkage which passes through aperture **11*c* and which is, in turn, interconnected with the inner slide 10** as will now be described.

Referring still to FIG. 1 of the drawings, it will be noted that an arm assembly 50 is fixed to and depends from the bottom surface of the inner slide 10 and projects downwardly so that its extended end provides a pivot point for the elongate arm 51 which is pinned thereto. One end of arm 51 is pinned to a connecting link 52 which is in turn pinned and secured to a turnbuckle 54.

This turnbuckle 54 is received on the threaded proximal end 43 of the shaft 41 of the stripper assembly 40 thereby making relative adjustment therebetween possible.

The opposed end of the arm 51 is pinned to a connecting link 53, which is in turn connected to the housing of a piston 60, which is reciprocal within the cylinder 61. The cylinder 61 is connected through bore **61*a* to a source of fluid pressure (not shown). That pressure is sufficient to force the piston 60 to the position of FIG. 1 under normal circumstances thereby to cock the linkage as illustrated in FIG. 1. It will be noted that in this posture, stripper assembly 40** is in what may be called its retracted position.

It will also be seen, by reference to FIG. 1 of the drawings, that the outer slide 20 has a through central opening 21, which permits the draw horn riser 11 to move relatively of the outer slide. Outer slide 20 also presents a shoulder 22 to which is secured a contact ring 23 for purposes which will be described.

Finally, it should be noted that presses of this type also usually include some sort of means for engaging the container to hold it during the draw operation. That apparatus has not been illustrated here for clarity in illustrating the invention.

Figure 9:
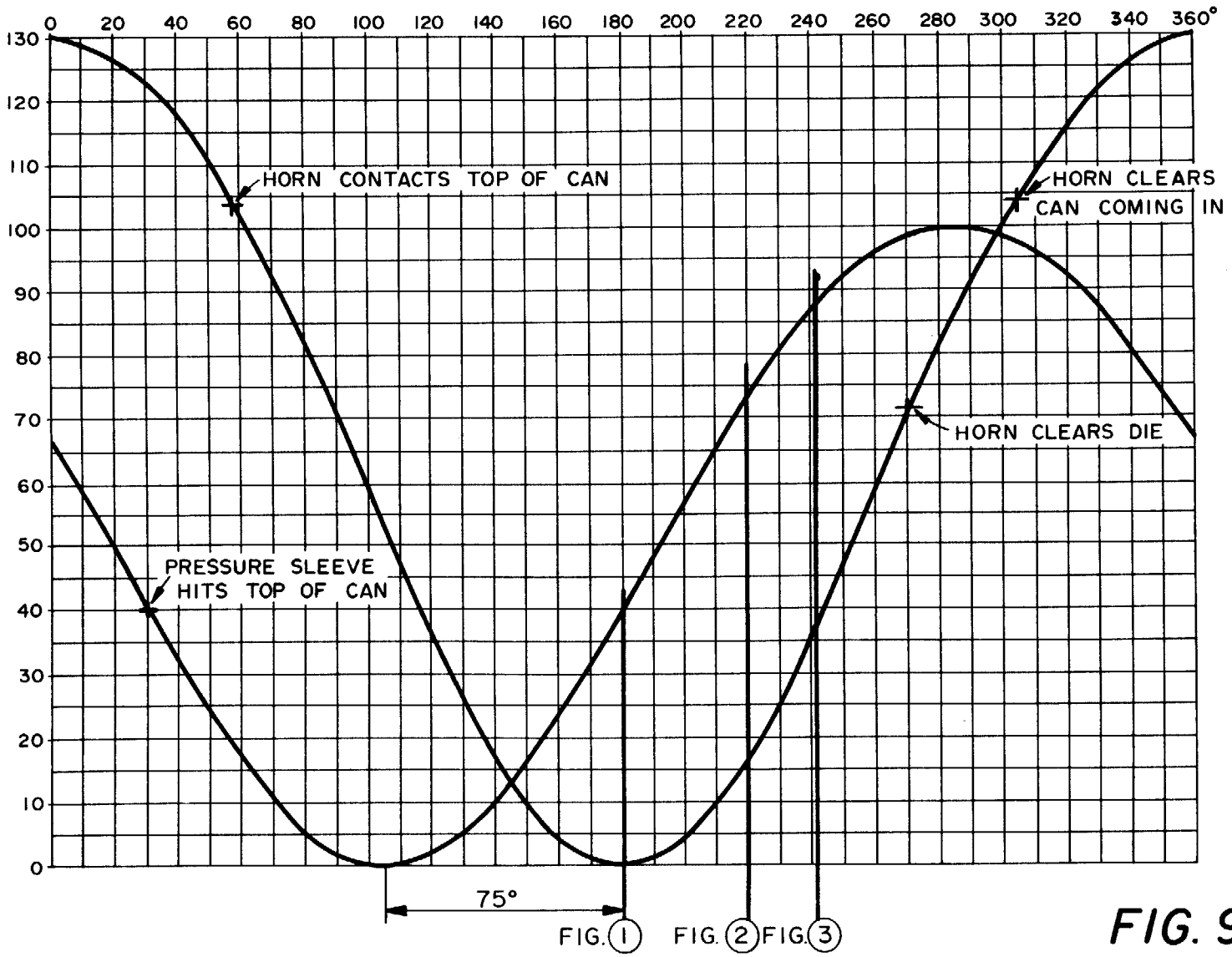
FIG. 9 is a cycle diagram illustrating the positions of the apparatus throughout an entire 360° cycle of operation.

Turning then to the method of operation of the apparatus just described and referring to FIGS. 1 through 9 of the drawings, attention is directed to the fact that FIG. 9 of the drawings is a timing diagram showing the relative positions of the inner and outer slides at various stages of the cycle.

Accordingly then, in operation, assuming a can C to have been positioned adjacent to the die carried by the bottom platen 30 and engaged by suitable hold down means (not shown), the inner and outer slides of the press can be activated to travel downwardly toward the platen. At this time, the stripper assembly 40 will be in the condition shown in FIG. 1. In other words, the pressure in the cylinder 61 will be forcing piston 60 to the position illustrated in FIG. 1 of the drawings, thereby cocking the arm 51 and retaining the stripper assembly 40 in its retracted position with pad 42 forming the bottom of horn 12.

After the draw has been completed, and the slides start up, it will be noted that both the outer and inner slides 10 and 20 both begin to move away from the platen 30. However, as noted in FIG. 9 of the drawings, the inner slide trails the outer slide. The degree is variable but in the form of the invention specifically illustrated herein, the difference is approximately 30 degrees. As this upward movement continues, the outer slide will move to the position illustrated in FIG. 2 of the drawings at which time the contact ring 23 will engage the bottom of the connecting link 53.

Figure 2:
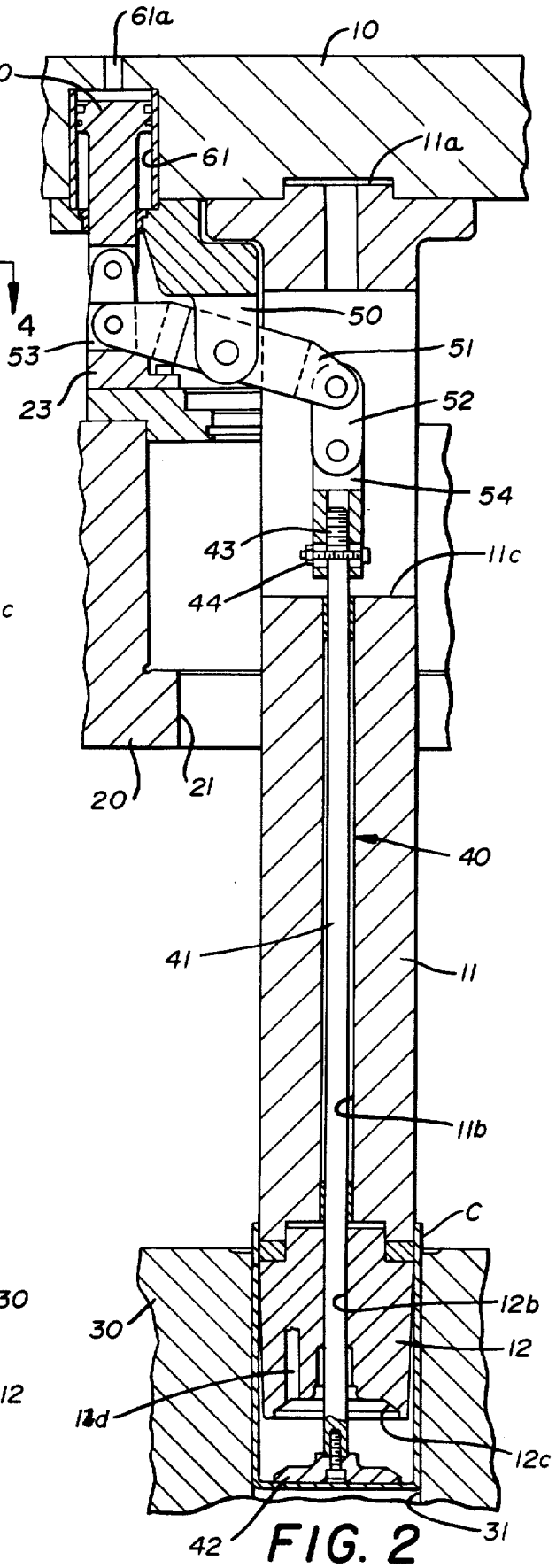
FIG. 2 is a view similar to FIG. 1, showing partial upward movement of the inner and outer slides and consequent extension of the stripper assembly.

The force and pressure of movement of the outer slide 20 is sufficient to overcome the pressure in cylinder 61 thereby moving the piston upward to the position shown in FIG. 2 of the drawings. This will, of course, permit the arm 51 to pivot and also will permit the stripper assembly 40 to move to the extended position illustrated in FIG. 2. It should be noted at this point that what is actually happening during this operation is that the stripper pad 42 is not really being pushed into the can C to force it off the end of the horn, but is simply being maintained at a more or less constant position relative to the bottom of the container C while the horn 12 is, in effect, pulled out of the container C. This is in contrast to some of the prior art wherein a knock out assembly is driven into the can thereby raising the possibility of damage to the bottom of the can. This is also important where the cans have a chemical coating on their inner surface and where that coating must be maintained intact. Therefore, sharp or violent contact with the interior surfaces of the container will damage the coating. That is not the case in the present invention.

It will be appreciated that draw horn 12 is slightly tapered from its top end adjacent riser 11 to bottom or distal end. This taper is greatly exaggerated in the drawings but the result is that the principal stresses tending to freeze the container to the horn occur in the upper portion of the container. Thus, the stripper assembly is operative to strip this portion (about 75% in practice).

In some instances this may be sufficient to completely dislodge the container. Where it is not, application of air through bores 11*d* and 12*d* of riser 11 and horn 12 will suffice to force the remainder of the container from the horn.

Once the container C has been fully stripped, it can pass on through the die in the direction of arrow 70 onto a conveyor or other means for transferring it to another station for subsequent operations.

Figure 3:
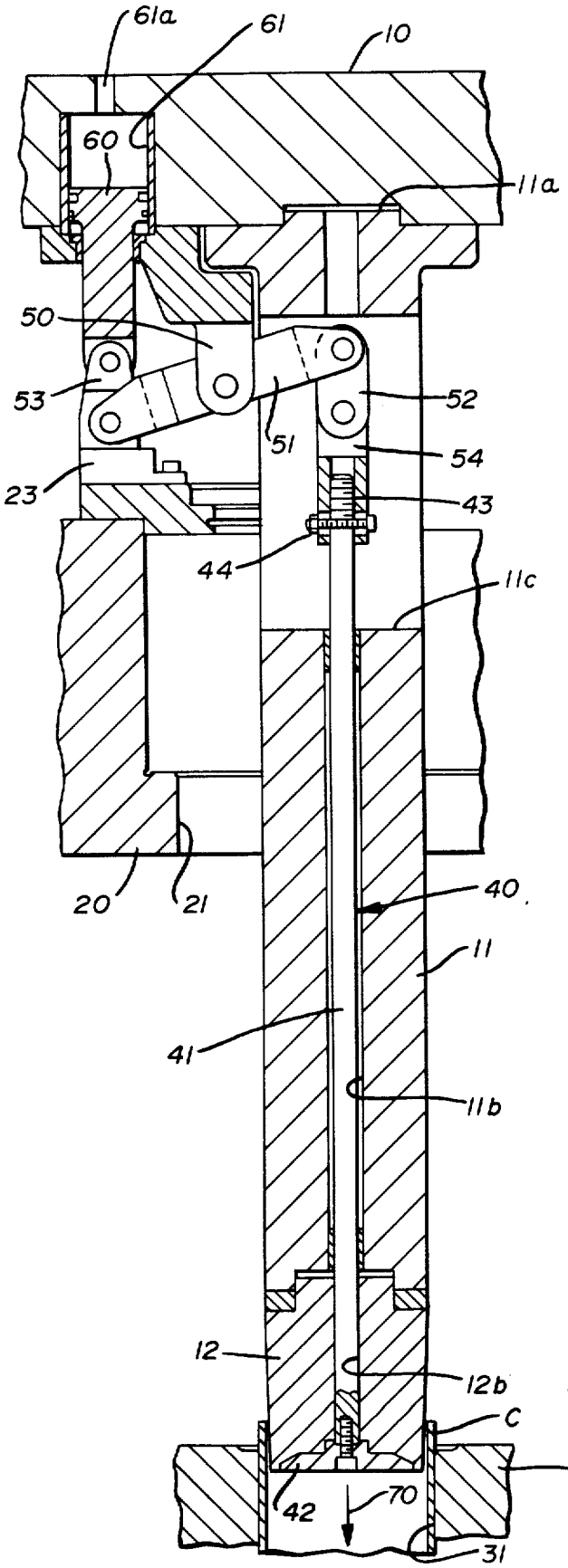
FIG. 3 is a view similar to FIGS. 1 and 2, showing the inner and outer slides almost fully retracted with the drawn container about to be completely stripped.
Figure 4:
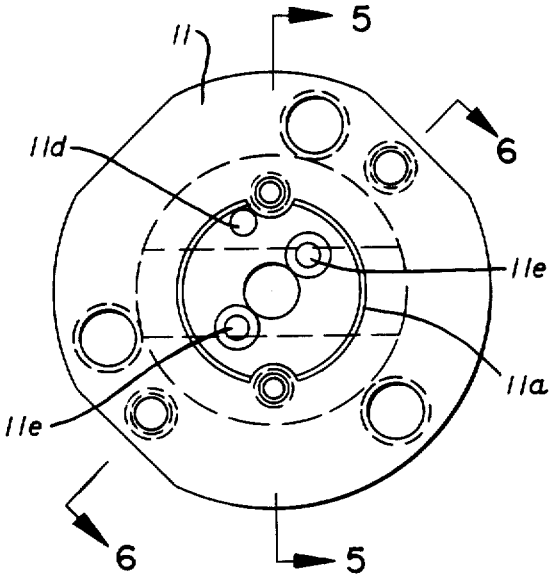
FIG. 4 is a sectional view taken along the line 4—4 of FIG. 1.
Figure 7:
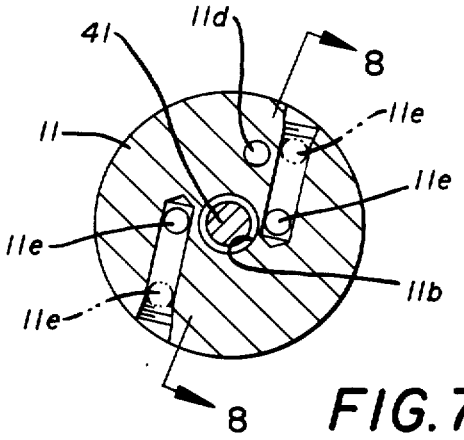
FIG. 7 is a sectional view taken along the line 7—7 of FIG. 5.
Figure 5:
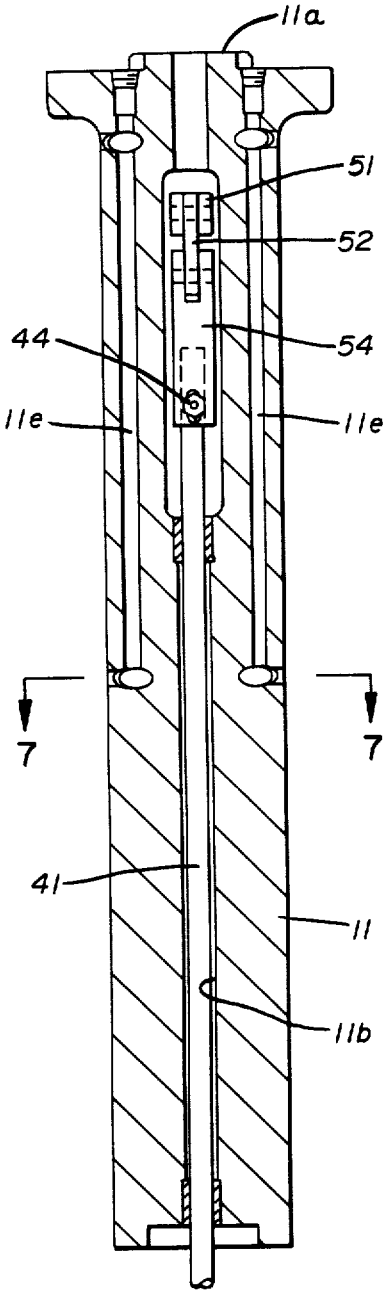
FIG. 5 is a sectional view taken along the line 5—5 of FIG. 4.
Figure 6:
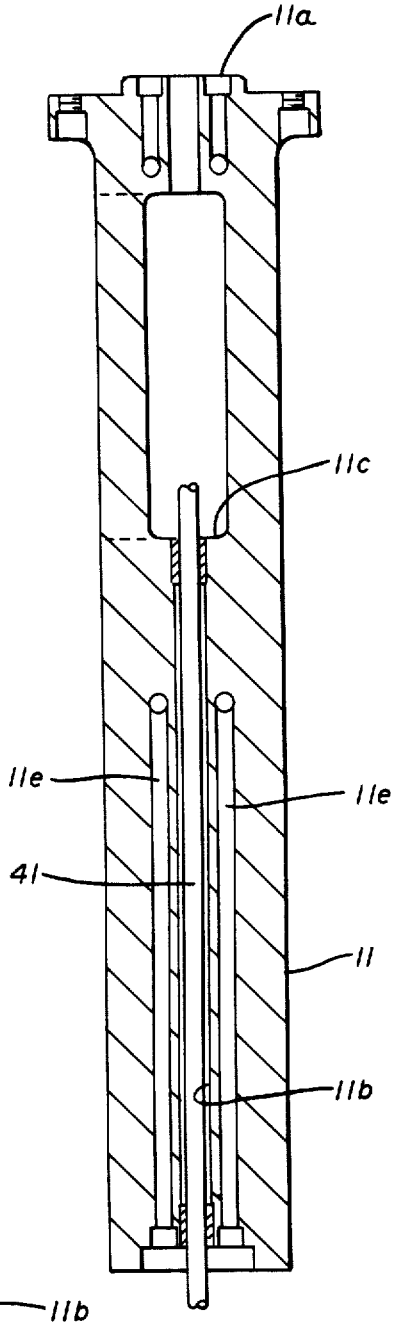
FIG. 6 is a sectional view taken along the line 6—6 of FIG. 4.
Figure 8:
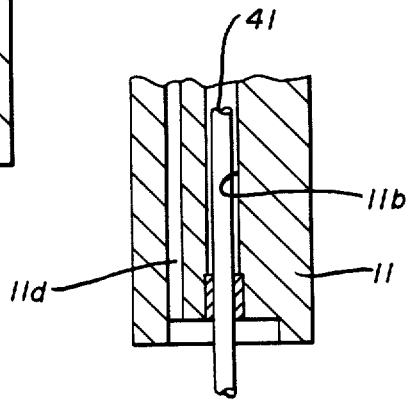
FIG. 8 is a sectional view taken along the line 8—8 of FIG. 7.

Continued upward movement of the inner and outer slides 10 and 20 will bring the apparatus to the position of FIG. 3, and slight additional movement will cause the apparatus to clear the die line and as the outer slide reaches top dead center, it will release its pressure or contact on the connecting link 53 thereby permitting the piston 60 to resume its function of cocking the stripper assembly 40 to the retracted position, thereby repositioning the tooling for the next cycle.

While a full and complete description of the invention has been set forth in accordance with the dictates of the Patent Statutes, it should be understood that modifications can be resorted to without departing from the spirit hereof or the scope of the appended claims.

For example, it should be noted that in the drawings, only one piston 60 and linkage 50, 51, 52, 53 have been illustrated. It is apparent that if desired, for balance, additional similar linkages could be provided.

It should also be noted that, depending upon the dimensions of the container being drawn in the apparatus, the stroke or movement of the stripper assembly 40 can be adjusted by altering the lever position by use of the turnbuckle 54.

What is claimed is:

1. Apparatus for removing a cylindrical member from a drawing horn carried by the inner slide of a double acting press having reciprocal inner and outer slides, comprising:

(A) an elongate draw horn and riser assembly secured to the inner slide for movement therewith toward and away from the base of the press;

(B) a stripper assembly carried by the inner slide and disposed within said draw horn and riser assembly for axial movement relatively therebetween; and (C) actuating means carried by the outer slide for engaging said stripper assembly while moving said draw horn and riser assembly axially relatively thereof during movement of the inner and outer slide away from the base of the press.

2. The apparatus of claim 1 wherein said draw horn and riser assembly includes a second bore connected to a source of air under pressure.

3. The apparatus of claim 1 wherein said draw horn tapers from a maximum diameter adjacent said riser to a minimum diameter at its distal end.

4. The apparatus of claim 1 wherein (A) said draw horn and riser assembly has a central bore extending inwardly from its distal end;

(B) said stripper assembly includes an elongate shaft, having first and second ends, received in said central bore;

(C) said second end of said elongate shaft being connected to the inner slide;

(D) means carried by said inner slide for normally retaining said stripper assembly in retracted position relatively of said draw horn; and (E) said last mentioned means being engaged by the outer slide upon upward movement thereof to permit said draw horn to move axially of said stripper assembly.

5. The apparatus of claim 4 wherein (A) a pivoting linkage interconnects said second end of said shaft to the inner slide; and (B) said means for normally retaining said stripper assembly in retracted position including a piston in contact with one end of said pivoting linkage.

6. The apparatus of claim 4 wherein said second end of said shaft is adjustably connected to said pivoting linkage.

7. The apparatus of claim 4 wherein (A) said draw horn and riser assembly includes a radially extending opening communicating with the proximal end of said central bore;

(B) said second end of said shaft being secured to the inner slide by a pivoting linkage, one end of which extends through said radially extending opening; and (C) a piston carried by the inner slide and connected to the projecting end of said pivoting linkage.

8. A method of forming a cylindrical member in a double acting press having reciprocal inner and outer slides comprising the steps of:

(A) drawing the member by engaging it with a draw horn carried by the inner slide;

(B) retracting the inner slide, the draw horn carried thereby and the drawn member;

(C) stripping the member from the draw horn by holding a stripper pad carried by the inner slide relatively of the draw horn to engage the member while withdrawing the draw horn axially relatively thereof.

9. The method of claim 8 wherein said stripper pad is carried by the inner slide and is positioned axially with respect to the draw horn by retracting movement of the outer slide.

10. The method of claim 8 wherein air under pressure is applied to the bottom of the drawn container to assist the stripper pad in stripping the member from the draw horn.

* * * * *